United States Patent [19]

Desai et al.

[11] 4,265,371

[45] May 5, 1981

[54] FOODSTUFF VENDING APPARATUS EMPLOYING IMPROVED SOLID-STATE TYPE CONTROL APPARATUS

[75] Inventors: Mahendrakumar D. Desai, Colonia, N.J.; Drew Henderson, Georgetown, Conn.

[73] Assignee: Trafalgar Industries Inc., New York, N.Y.

[21] Appl. No.: 949,052

[22] Filed: Oct. 6, 1978

[51] Int. Cl.[3] ..... B67D 5/06

[52] U.S. Cl. ..... 222/70; 222/129.4; 364/900

[58] Field of Search ..... 222/70, 129.1-129.4, 222/52, 59, 76; 364/900

[56] References Cited

U.S. PATENT DOCUMENTS

| | | | |
|---|---|---|---|
| 3,409,176 | 11/1968 | Krause | 222/129.4 X |
| 3,428,218 | 2/1969 | Coja | 222/70 X |
| 3,638,832 | 2/1972 | Sauber et al. | 222/76 X |
| 3,688,947 | 9/1972 | Reichenberger | 222/129.1 X |
| 3,777,937 | 12/1973 | Buck | 222/70 |
| 4,011,967 | 3/1977 | Halsey et al. | 222/70 |

*Primary Examiner*—Joseph J. Rolla

*Attorney, Agent, or Firm*—Lerner, David, Littenberg & Samuel

[57] ABSTRACT

Foodstuff vending apparatus employing improved solid-state control is provided in accordance with the teachings of the present invention. In accordance with the teachings of the present invention, a processor and accompanying memory are relied upon to cause vending to occur in a programmed sequence in accord with selected vending conditions. The processor and memory are programmed in a manner to ascertain when a vending operation is about to be initiated and thereafter to invite an operator to specify a product to be vended and conditions under which such product is to be vended. Elements of the product to be vended are then dispensed, under program control, in accordance with the product designated and the conditions specified at selectable rates which are readily variable.

42 Claims, 3 Drawing Figures

FOODSTUFF VENDING APPARATUS EMPLOYING IMPROVED SOLID-STATE TYPE CONTROL APPARATUS

BACKGROUND OF THE INVENTION

Automatic vending machines are quite well known and are employed in just about every conceivable physical location such as, for example, factories, office buildings, institutional and education facilities, retail establishments, public gathering places, airport terminals, train stations, and the like. Automatic vending machines are utilized to vend a wide variety of items, including solid, as well as liquid based foodstuffs. Vending machines for vending liquid based foodstuffs such as hot and cold drinks, soup, and the like, typically offer a selection of foodstuff ingredients which may be combined with a liquid or selections wherein the liquid may be combined with one or more foodstuffs added in varying degrees of strength or concentration in accordance with the particular selection. For example, a coffee vending machine may offer black coffee, coffee with cream, coffee with sugar and cream, etc. As regards concentration, the machine may offer coffee with cream, coffee with extra or double cream, coffee with sugar, coffee with double sugar, and so forth.

The amount of each ingredient dispensed is conventionally controlled by cam operated switches which control the duration of energization of a dispensing device. For example, in locations in which it is required that an eight ounce drink is to be dispensed, the liquid is passed therethrough at a predetermined flow rate. By adjustment of the cam operated switch means, the valve may be energized, i.e., maintained in the open position, for an interval which is related to the flow rate so as to be sufficient to dispense the desired quantity of liquid. Similar cam operated switches are utilized to control the interval of energization during which powdered ingredient dispensing means are maintained operative to dispense the proper quantity of the powdered ingredient.

Typically, it becomes necessary to make adjustments in the cam operated switches in order to control the amount of the ingredient being dispensed to compensate for differences in dispensing devices, etc., and, although the cam assemblies are designed to be adjusted, such adjustments are quite difficult and require "cut and try" techniques before the proper adjustment is obtained, thus making maintenance and/or machine installation a tedious and complicated procedure.

The overall number of mechanical switches necessary to provide the desired number of selections further complicates the vending machine. In addition, mechanical switches of both the selection and cam operated type are subject to wearing, requiring added maintenance activity.

BRIEF DESCRIPTION OF THE INVENTION

The present invention is characterized by providing a solid-state microcomputer based control system adapted to convert most, if not all, of the conventional functions of a vending machine typically performed by mechanical apparatus into electronic signals and/or electronic control operations, thereby remarkably reducing the number of mechanical and electromechanical components otherwise required in conventional apparatus, as well as reducing the size and complexity of the apparatus, and, at the same time, increasing the capability and versatility of the vending apparatus.

The microcomputer includes memory means for storing a program adapted to initiate all of the vending machine functions typically performed either mechanically or electromechanically in conventional vending apparatus, as well as incorporating new and unique functions and capabilities to provide equipment which is less complicated from a maintenance and servicing viewpoint and which is more reliable due to the significant reduction in the number of mechanical and electromechanical components utilized in the system, as well as providing flexibility not capable of being attained with conventional apparatus.

As is the case with conventional equipment, operation is begun by the insertion of a coin. Recognition and acceptance of a valid coin invites the apparatus operator to select the desired drink and its ingredients and/or strength of ingredients. The program provides for the multiplexed use of a common bank of switches such that, in one preferred embodiment, a bank of eight switches are operated to provide up to 24 different selections, if desired.

Based upon the particular selection, the program follows the appropriate program routines associated with the selections made. For example, upon selection of a particular hot drink, the appropriate amount of liquid and other ingredients making up the drink are dispensed into a common mixing bowl which, in turn, dispenses the admixed ingredients into a common receptacle. Each of the ingredients is dispensed substantially simultaneously or in overlapping intervals, although in certain instances, some ingredients may be dispensed in sequential fashion. The dispensing interval for each ingredient is basically a function of the amount of the ingredient to be dispensed. For hot drinks, the hot water is typically dispensed over the longest time interval in order to serve as the admixing medium, as well as the liquid based ingredient of the drink.

Determination of the quantity of liquid and of the ingredients to be dispensed, as well as the simplified and yet precision adjustment of the amount of ingredient to be dispensed, is accomplished through the cooperative relationship of the microcomputer in cooperation with settable switch means. For example, in order to dispense a desired amount of liquid, the program, at a predetermined point in the routine, develops a dispensing control signal to initiate operation of a solenoid or a motor, for example, depending on the particular ingredient. The processor also causes a scan signal to be applied to the input of each switch means associated with those ingredients to be dispensed. The scan signal appears at one of the plurality of outputs of the switch, dependent upon the setting of the adjustable switch arm. This output is converted into a time value and is stored in a register in the computer. During a vending cycle, the aforesaid register cooperates with the microprocessor in such a manner as to function as a timer which has its contents altered, such as being decremented by a timing pulse developed by the processor. When a predetermined count is reached in the register, i.e., when the register "rolls over", the task associated with that timer value is performed. In this case, the aforesaid solenoid is turned off, terminating the dispensing time interval for the ingredient being dispensed.

A cycle timer, preferably in the form of a register and decrementing means, initiates the energization of each dispensing device dependent upon the operator's selection and in a predetermined sequence. The time value for each activity to be performed is set into an associated time register for each ingredient at this time, is decremented and is tested for "roll over", at which time the task for that time interval is performed. The task may be one which starts a dispensing interval, as well as one which terminates a dispensing interval.

The powdered ingredients are preferably dispensed during the time that the liquid ingredient is being dispensed in order to take advantage of the flow of water to admix the foodstuff ingredients within the appropriate mixing bowl. Each timer count is then preferably independently decremented and then examined to determine if it has rolled over to start or terminate each of the dispensing operations at a time in accordance with the count originally set into each timer register. Adjustment of the settable switch means permits a plurality of precise, programmable settings. Also, an interval counter in the computer is programmable to alter unit timing, and the scale factor for each ingredient may be altered if desired. In one preferred embodiment, the basic time interval value is programmable to obtain time intervals ranging from as small as 10 milliseconds to as large as 2.55 seconds. Even higher values can be obtained if desired to accomplish simplified changes in the vending cycle time, powder drop times and soda/syrup dispensing time.

The pumps and/or drive motors used to dispense the aforementioned ingredients are energized through the selective operation of reed switches which isolate the low d.c. power utilized to power the control circuitry from the high a.c. power utilized to drive the pumps and drive motors. The reed switches operate triacs such that the reed relays drive the triacs in both directions, providing full cycle a.c. on/off control especially advantageous for use with a.c. shaded pole motors.

Means are provided to monitor the a.c. power source and to energize motors, solenoids and the like only during a substantially zero crossover of the a.c. source. In the event of power brownout, the program is automatically reset to prevent the vending apparatus from performing incorrectly.

Any spurious signals or power disturbances which might cause a jump in the program beyond the final program step to an invalid memory location also cause an automatic resest of the program.

OBJECTS OF THE INVENTION AND BRIEF DESCRIPTION OF THE FIGURES

It is, therefore, one object of the present invention to provide a novel solid-state control for vending machines.

Another object of the present invention is to provide novel solid-state control means for vending machines, said control means being microcomputer based control apparatus having an operating program which provides for a large plurality of vending selections.

Still another object of the invention is to provide a microprocessor control for vending machines and the like which monitors a number of conditions to assure that switching and control operations are performed only during acceptable states of the conditions being monitored.

Still another object of the present invention is to provide novel solid-state control means for vending machines and employing switches which are manually settable for simply and readily adjusting the vending duration of the ingredient associated with the selectable switch to simply and yet accurately control the amount of each ingredient to be vended.

Another object of the invention is to provide an overall apparatus timer which automatically resets the microprocessor in the event that dispensing operations are not performed within an outside limit.

The above, as well as other objects of the present invention, will become apparent from reading the accompanying description and drawings in which:

FIGS. 1*a* and 1*b* are block diagrams which, taken together, show a vending apparatus embodying the principles of the present invention.

FIG. 2 shows a detailed flow diagram of a program utilized for controlling the apparatus of FIGS. 1*a* and 1*b*.

DETAILED DESCRIPTION OF THE INVENTION

Figure 1A:
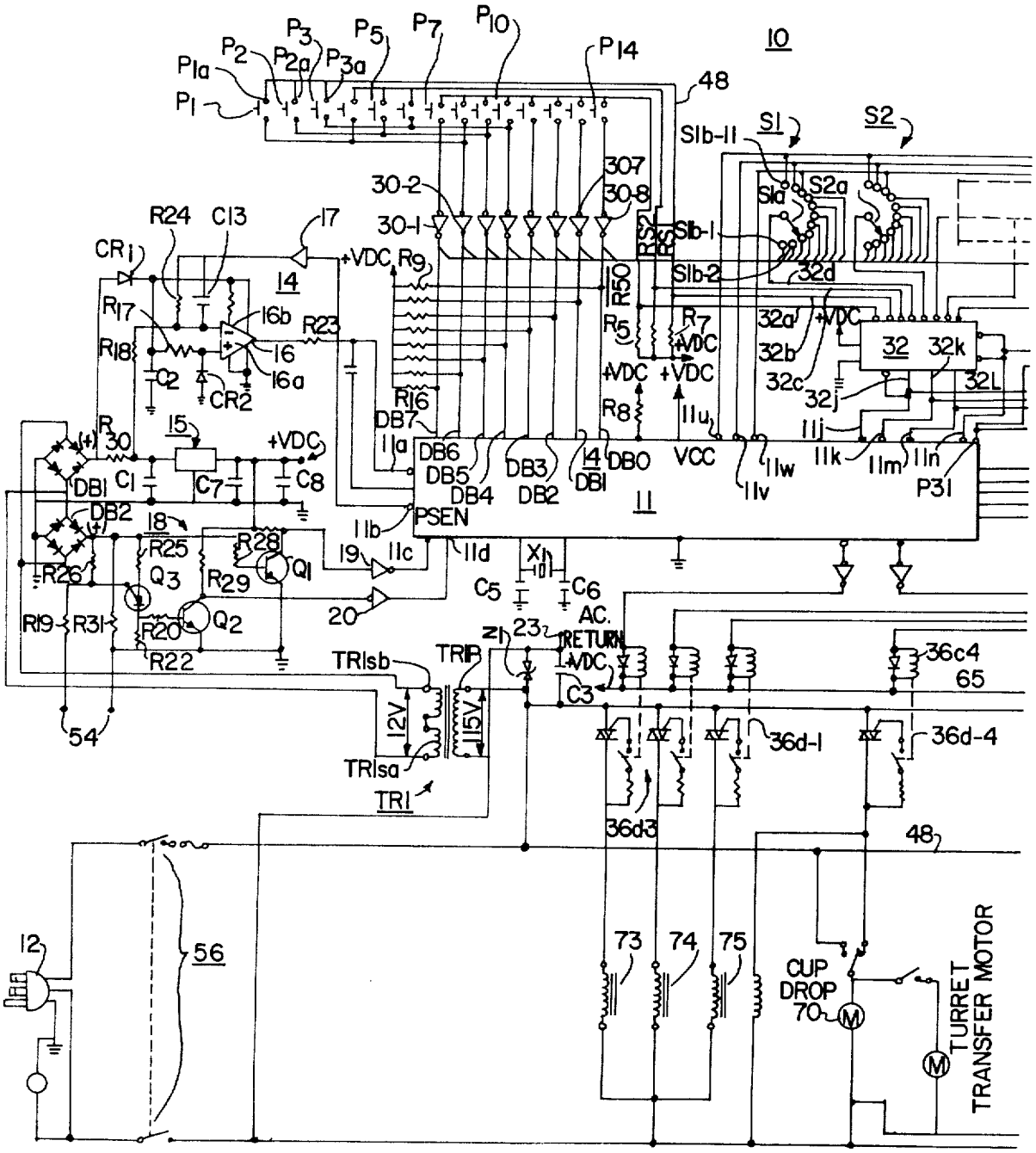
Figure 1B:
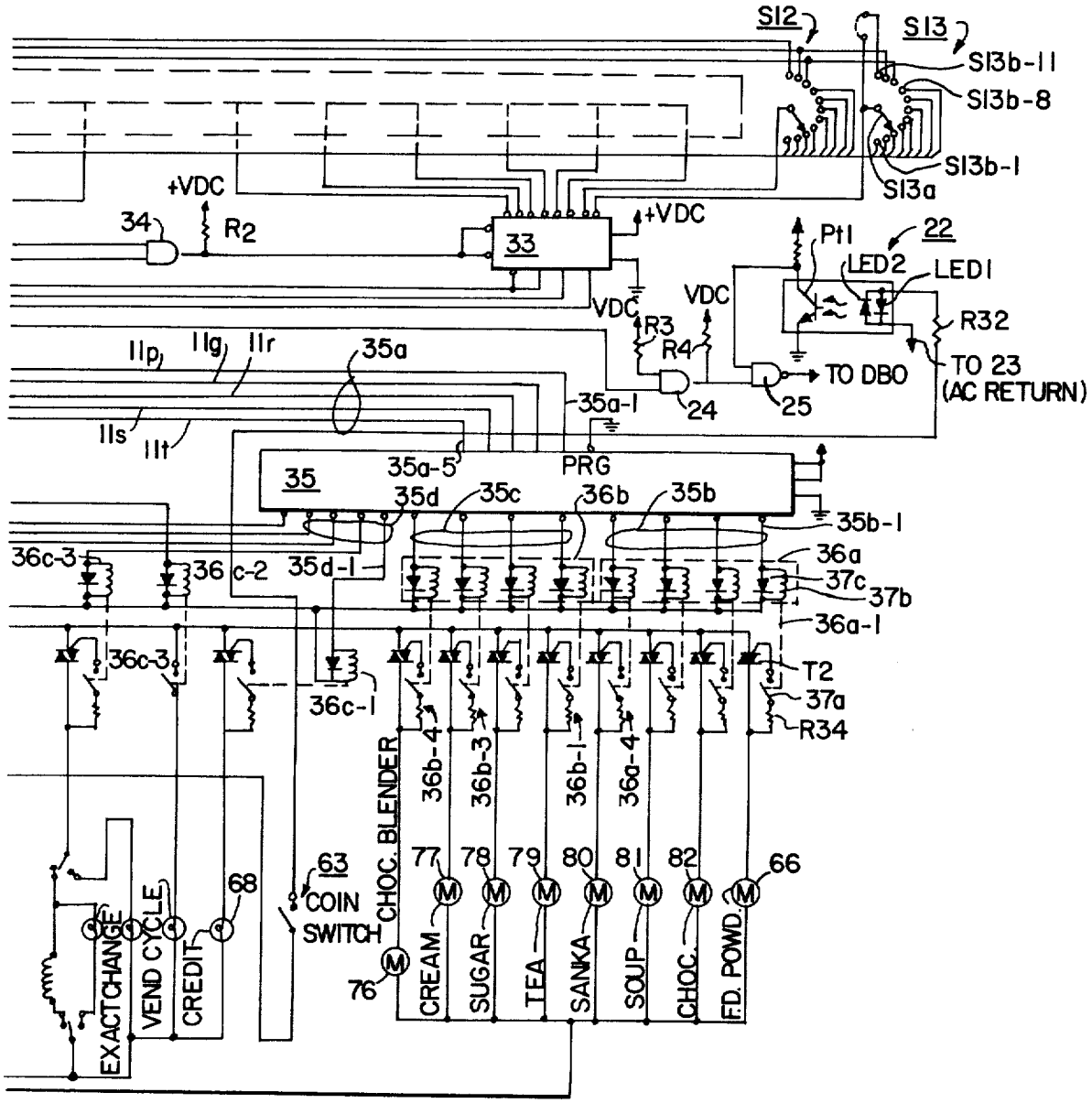

FIGS. 1*a* and 1*b* show a control system 10 for operating a vending machine and embodying the principles of the present invention. The system 10 is comprised of a processor 11 which may, for example, be an Intel microcomputer of the MCS-48 system described in the text "Intel MCS-48 Microcomputer User's Manual", copyright 1976 by Intel Corporation. The processor typically includes a central processor (CPU), program memory (ROM), data memory (RAM), input output (I/O) lines, and an event counter. The CPU typically comprises control circuits, registers and an Arithmetic/Logic Unit (ALU). For example, the block diagram appearing on page 2—2 of the aforesaid manual shows the conventional processor hardware configuration and is incorporated herein by reference thereto.

Sixty (60) Hz a.c. power is coupled to the input terminals of plug 12 from a power supply (not shown) which may be derived from a conventional wall outlet. Main switch 56 selectively couples a.c. power from plug 12 to transformer TR1 whose primary TR1p is coupled to input terminals 12 and whose secondary windings TR1sa and TR1sb are respectively coupled across the input terminals of full wave diode bridges DB1 and DB2. The output terminals of the diode bridge DB1 are coupled between ground reference and the smoothing and filtering circuit 15 to develop a d.c. level+VDC which is utilized to power the microprocessor 11 and other components of the control circuitry.

The (+) output terminal of diode bridge DB1 is also coupled through diode CR1 to a d.c. reference level circuit including capacitor C2, resistor R17 and zener diode CR2, which elements form part of the undervoltage detection circuit 14. The reference level is applied to the non-inverting input 16*a* of operational amplifier 16, whose inverting input 16*b* is coupled to the opposite terminal of resistor R30 through series resistor R18 to couple the signal being monitored to operational amplifier 16. The output of operational amplifier 16 is coupled through resistor R23 to the reset input 11*a* of microprocessor 11. Diode CR1 rapidly charges capacitor C2. Diode CR2 and high ohmic resistor R17 cause the capacitor C2 to discharge at a very slow rate.

Output terminal 11*b* of the microprocessor develops a signal whenever a program counter, provided in the processor, steps to a count which exceeds the preestablished capacity of the internal memory storing the program, thereby indicating an invalid condition. In such event, such output at 11*b* is coupled to the input of inverter 17 and the parallel connected RC combination of resistor R24 and capacitor C13, to the inverting input 16*b* of operational amplifier 16 for the purpose of developing a reset signal for initializing the processor and resetting the program to the starting point in readiness for accepting the next coin drop in the event that the maximum number of program steps is exceeded, for any reason, such as spurious signals in the system, ambient noise, and the like.

The undervoltage detection circuit 14 independently performs a similar reset function upon detection of a drop in operating voltage at the inverting input 16*b* relative to the slow-to-change reference level applied to its non-inverting input 16*a* to develop a reset triggering signal at the input 11*a* of the processor. A similar result is obtained when the input to the inverter 17 derived from the microprocessor output terminal 11*b* goes high to develop a low level signal at the inverting input 16*b* of operational amplifier 16 to thereby develop a reset output signal which automatically resets the program to its starting point in the presence of either an undervoltage condition or an invalid program step count, thereby respectively preventing low impulse noise on the power line from being erroneously interpreted as a valid signal so as to avoid the possibility of the program entering into a random loop and preventing invalid program steps from being erroneously interpreted as part of the normal operation.

A zero crossing detector circuit 18 is provided and is comprised of transistor Q1 having its base electrode coupled to the positive output terminal of diode bridge DB2 through resistor R28, while its collector is coupled to the +VDC power supply level. The emitter of Q1 is grounded. Each time the rectified, unfiltered 60 Hz signal goes substantially to zero (twice per cycle), the Q1 collector goes high to develop the zero crossing signal which is inverted by inverter 19 and is applied to the interrupt input 11*c* of microprocessor 11 which serves to interrupt or delay the performance of a switching operation except during the time at which a zero crossing occurs, which operation is accomplished in a manner to be more fully described hereinbelow. Zero crossings occur at twice line frequency or 120 Hz.

The system further includes a water flow sensing circuit comprised of a silicon-controlled switch Q3 and transistor Q2. Q2 is powered by the +VDC supply through collector coupled resistor R29. The anode of switch Q3 is coupled to the positive (+) output of the full wave diode bridge DB2 through resistor R25. The Q3 cathode is coupled to ground through resistor R22 and is coupled to the base of Q2 through resistor R20. The Q3 control electrode is coupled to the common terminal between resistors R26 and R19. A conventional flow sensor (not shown) is coupled by terminals 54 between the opposite terminal of R19 and ground. The sensor switch is normally open in the presence of water flow. The level of the voltage at the Q3 gate turns Q3 on. The voltage drop across R22 turns Q2 on. The sensor switch closes in the absence of water flow to turn off silicon-controlled-switch Q3 and transistor Q2, thereby placing a high level at the collector of Q2 and at the input of inverter 20 and a low level at input 11*d* of the microprocessor 11. When one of the water valves is opened and water flow from the water tank is normal, the sensor contacts across terminals 54 are normally open, causing the Q2 collector to stay low and to go high only at the time of zero crossings, thereby placing a high level upon input terminal 11*d* of the microprocessor, except at the instant at which a zero crossing occurs. This condition is used to monitor water flow and to terminate the dispensing of powders if water flow is interrupted. The condition is applied to input 11*d* of microprocessor 11. This input is typically referred to as the T0 input of the microprocessor in the above-mentioned manual.

A credit impulse interface circuit 22 is comprised of a pair of light emitting diodes, LED1 and LED2, respectively, coupled in parallel and with opposing polarity across a.c. return lead 23 and one terminal of resistor R32. The opposite terminal of resistor R32 is coupled to the coin receiving mechanism (not shown) which couples a.c. power through coin switch 63 to LED1 and LED2 when a coin has been deposited. The light emitted by LED1 and LED2 during alternate half-cycles of the a.c. input activates phototransistor Pt1 to provide a low level to one input of NAND gate 25 whose other input is normally maintained at a high level by the supply source +VDC through resistor R4. The aforesaid remaining input of NAND gate 25 is also coupled to the output of NAND gate 24 having one of its inputs normally maintained at the +VDC source level through resistor R3. The remaining terminal is coupled to one output 11*e* of microprocessor 11.

The output of NAND gate 25 is coupled to one data input, DB0, of microprocessor 11. The optical isolation permits the use of any coin accepting device without the need for any special electrical interface. Credit status is examined during the program to initiate the program cycle as will be more fully described hereinbelow.

Once credit is established, the program selectively enables manually operable push buttons P1–P14 provided for the selection of the drink and the strength of the ingredients. The push buttons are energized in a multiplexed fashion to provide a significant increase in the number of selections which can be made for the same given number of operating push buttons and also reduces the number of input lines required to transfer data from the push buttons to processor 11.

The push buttons P7–P14 are coupled through inverters 30-1 through 30-8 to the data input lines DB1 through DB7, which data is utilized during the program cycle to dispense the selected drink having ingredients of the selected strength. The push buttons P1–P3 are coupled to data lines DB7–DB5, as are the push buttons P4–P6.

The enable lines of the push buttons are coupled to outputs 32*a*–32*c* of decoder 32, which decoder is adapted to enable only one of its eight output lines under control of a four bit binary control word applied in the form of signal levels to its input lines 32*j*, 32*k*, 32*l*, and 32*m*, which are respectively coupled to output control lines 11*j*, 11*k*, 11*m*, and 11*n* of processor 11. The states of the group of push buttons whose enable line has been activated are stored in predetermined locations in the processor's memory (RAM). This data is utilized during the execution of a subsequent program routine to develop time values as will be more fully described.

Upon completion of that part of the program cycle which determines the drink which has been selected and the strength of the ingredients for the selected drink, selected ones of the battery of switches S1–S13 are scanned to determine the time intervals during which each dispensing device for the appropriate ingredients is to be energized. The switches are scanned by a program routine which applies control signals to decoder 32, decoder 33, and gate 34 through outputs 11*j*–11*n* and 11*e* for selecting each switch to be scanned on a one-at-a-time basis and placing the signal states of all output lines of the selected switch upon the data input lines DB1-DB7 (for S1b-1 through S1b-8), and lines 11*u*, 11*v* and 11*w* (for S1b-9 through S1b-11). It should be understood that all output lines of like number are connected in common to the same microprocessor data input line. For example, output lines S1b-1 through S13B-1 are all connected in common to data line DB7, S1b-2 through S13b-2 are connected to data line DB6, and so forth. Gate 34 serves to disable decoder 33 when decoder 32 is selected and vice versa. In accordance with the position of switch arm S1a, only one output line of switch S1 carries the scan signal. This condition is examined during that portion of the program cycle which controls the activation of the dispensing devices. The switch arms S1*a*-S13*a* of each of the switches S1-S13 are preset by maintenance personnel to control the time duration of each dispensing device in accordance with the needs of each location. Adjustment is very simple, since it necessitates movement of the switch arm into any one of the 11 discrete switch positions and yet allows for accurate adjustment of the amount of ingredient to be dispensed.

A subsequent routine of the program examines the data representative of the switch settings of selected switches to calculate the time interval for each of the ingredients to be dispensed. The processor then develops signals which are coupled to output lines 11*p*—11*t* to respective inputs 35*a*-1 through 351-5 of I/O expander 35 having three four-bit bidirectional static I/O ports 35*b*-35*d* which serve to couple control signals to the selected dispensing motor and one four-bit port 35*a*-2 to 35*a*-5 which serves as an interface to the microprocessor. Binary control signals appearing at outputs 11*p*-11*t* are applied to terminals 35*a*-1 through 35*a*-5 of port 35*a*, and a clock input is applied at 35*a*-1 to cause at least one terminal of each of the three four-bit ports 35*b*-35*d* to be shifted to the enable state in order to enable at least one of the reed relays in four associated groups of reed relays 36*a*, 36*b*, 36*c*, and 36*d*, respectively, each group incorporating four such reed relays such as group 36*a* which incorporates reed relays 36*a*-1 through 36*a*-4. The reed relays are identical in design and function, and only one will be described herein for purposes of simplicity.

Considering reed relay 36*a*1, the relay comprises reed elements shown schematically as a switch arm 37*a* and which elements are mechanically biased so as to provide a normally-open condition. Although not shown for purposes of simplicity, the reed relay has its reed elements encapsulated within a hermetically sealed evacuated glass envelope. A solenoid winding 37*b* surrounds the hermetically sealed envelope and has one of its terminals coupled to source +VDC through bus 65 and has its other terminal coupled to output line 35*b*-1 of I/O expander 35. The reed switch is designed to be normally open when winding 37*b* is deenergized. A diode 37*c* is coupled in parallel across winding 37*b* to prevent damage to the I/O expander 35 due to inductive "kick back" voltage. When it is desired that the reed relay be maintained in the normally open state, the level at line 35*b*-1 is maintained at substantially the power source level +VDC. When it is desired to perform the switching operation, the level at line 35*b*-1 drops to reference potential (typically zero volts or ground) causing a current to pass through winding 37*b* to establish a magnetic field sufficient to close contact 37*a*. A triac T2 has its power terminals respectively coupled to the a.c. return line and to a motor 66 for dispensing freeze-dried coffee, for example. The remaining power terminal is also coupled to the gate electrode of the triac T2 through resistor R34 and switch 37*a* which is now closed. As a result, the triac gate triggers triac T2 on, and a.c. power is coupled to the ingredient dispensing apparatus comprising a dispensing motor which drives the ingredient from a container into a conventional mixing bowl (now shown) for receiving the ingredients of the selected drink. As was described hereinabove, switching is delayed until the a.c. signal passes through zero to prevent arcing and phase mismatch between power source and load, thereby increasing the operating life of all circuit components. In addition, the triacs are capable of being driven in both directions to provide full cycle a.c. on/-off control which is especially advantageous for operating a.c. shaded pole motors. The reed relays provide total isolation between the high power a.c. for operating the vending motors and the low power d.c. utilized in the computer control circuitry. Also, the reed relays provide an inexpensive switching device having long life and quick response characteristics. Other isolation means such as opto-isolators may be employed if desired.

Figure 2:
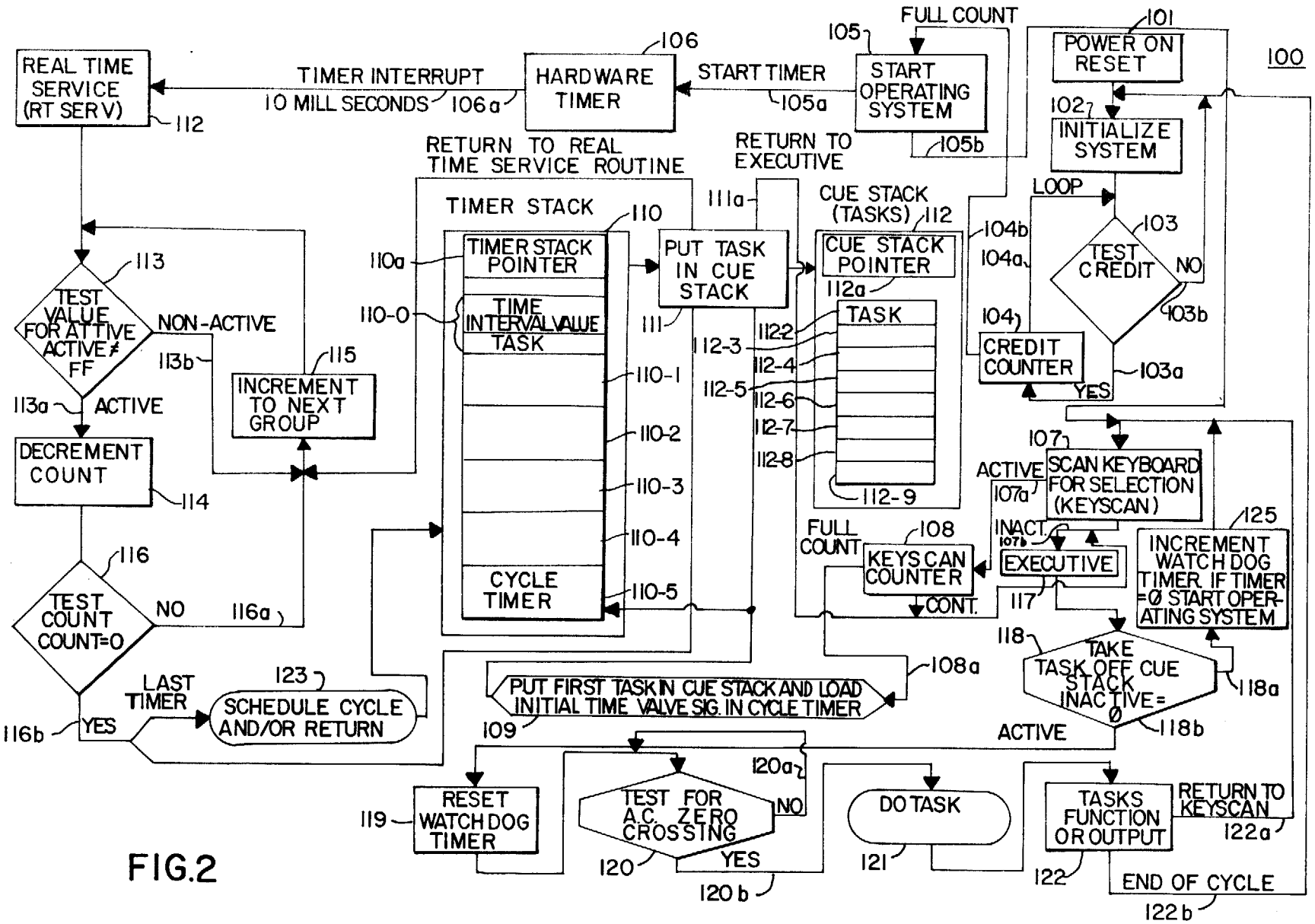

The computer control operation of a typical program cycle can best be understood from a consideration of the flow diagram shown in FIG. 2 which will now be considered in conjunction with the block diagram of FIG. 1.

Assuming that the plug 12 has been inserted within an energized wall socket, the system is powered by closing switch 56. (See FIG. 1). The power-on condition is sensed by the processor reset input to cause a reset of the program cycle as represented at 101 of FIG. 2. Reset causes initialization of the system at 102, which, upon deposit of a coin, begins a test credit routine under control of a test signal periodically created at output terminal 11*e* of processor 11 and applied to gate 24. The gate 24 has its output normally maintained low, but is caused to go high under control of the test signal periodically created at output terminal 11*e* of processor 11. In the event that no coin is present during a credit check, or in the event that the coin switch contacts are experiencing contact "bounce", the output level of the collector of Pt1 will be high, developing a low level at the output of gate 25, indicating the absence of credit as represented by the NO condition at line 103*b* in FIG. 2. When a coin is deposited, coin switch 63 is closed to establish an a.c. path from bus 48 through the closed coin switch to the light-emitting diodes LED1 and LED2 to the opposite terminal being coupled to the a.c. return. LED1 and LED2 are alternately energized, causing light to be emitted from the LEDs during alternate half cycles of the a.c. wave. The light is sensed by phototransistor $P_{t1}$ to cause the output at the collector $P_{t1}$ to go low, causing the output of gate 25 to go high to establish a credit condition.

This condition is represented by the YES signal path 103*a* of the test credit operation 103 which causes a pulse to be applied to a credit counter 104 (not shown), provided within microprocessor 11, preferably in the form of a dedicated location in memory (RAM) or one of the working registers provided in the processor 11. As long as the count in counter 104 is less than a preset number, output 104*a* of the credit counter applies a level to the input of the test credit control to continue the test for credit. Thus, the condition at gate 24 and, hence, gate 25 is read into the microprocessor (at the 80 microsecond rate) a plurality of times before credit is established. Each valid condition read into the processor causes counter 104 to be incremented by one count. After a predetermined number of counts has been accumulated, output 104*a* of the credit counter is disabled, and output 104*b* is enabled to cause the program to enter into the start operating system routine of the program cycle as represented at 105. This routine enhances the system's security.

The above description presupposes that each test credit pulse yields a "yes" condition. In the event that any of the tests for credit pulses result in a "no" condition (i.e., switch is not closed), as represented by output line 103*b*, the system is again initialized, and the credit test begins anew. Thus, the number of credit pulses developed must occur in an unbroken series.

Upon reaching the full count, the start operating system routine establishes at 105 an enable signal 105*a* for hardware timer 106, as well as signal 105*b*, which initiates the scan keyboard routine 107 of the program.

The hardware timer 106 is comprised of a multistage counter advanced by pulses occurring at 80 microsecond intervals, said counter having stages sufficient in number to generate pulses at the timer interrupt output 106*a* at 10 millisecond intervals.

When the full credit condition is established, the full count signal 104*b* also develops an output signal which illuminates the credit lamp 68. Note FIG. 1 wherein output 35*d*-1 of I/O expander 35 energizes relay 36*c*-1 to close its associated reed switch and thereby establish a current path across the a.c. power line to light the credit lamp 68.

During the keyboard scan portion of the program cycle, the microprocessor develops signals for controlling decoder 32 to sequentially develop signals at its outputs 32*a*–32*c*, respectively. A signal level is developed initially on line 32*b*, enabling the line 48 coupled to one stationary terminal P1*a*, P2*a*, and P3*a* of push buttons P1, P2, and P3, respectively. The depressed push button couples the signal level on line 48 through its associated inverter from the group of inverters 30-4 to 30-2 to apply a data input signal to the associated line of the data inputs DB4-DB6, respectively. These lines are monitored for the presence of at least one switch closure among the three lines at a rate determined by the system clock which generates pulses at a pulse rate of 80 microseconds. It should be noted that the data lines DB0-DB7 can accommodate up to 8 push buttons, if desired, to allow a similar number of drink selections. So long as a valid switch closure is present (and this is determined by a predetermined count of pulses being accumulated in a key scan counter 108 in the processor), the data is loaded into memory. When all three lines 32*a*–32*c* have been scanned, output 108*a* from scan counter 108 triggers the next program routine 109.

During program routine 109, the first operation to be performed (cup drop) is loaded from memory into the cue stack 112. Cue stack 112 comprises a plurality of memory locations, each capable of storing a task word and having a cue stack pointer 112*a* which electronically and continuously scans each of the memory locations in the cue stack and stops when it finds a task word in a memory location to undertake that task. Also, as part of routine 109, the initiate signal time values for all the remaining tasks associated with the selected drink and strength of the ingredients are loaded into the cycle timer location 110-5 of the timer stack 110 with the time values bearing a set relationship with respect to the cup drop. The Timer Stack 110 comprises a group of memory locations, each capable of storing a time interval and the task associated therewith. Timer stack pointer 110-*a* of the timer stack 110 is adapted to scan each of said memory locations and extract the contents thereof for performing a particular function, to be more fully described. Selected ones of the memory locations in timer stack 110 constitute the Cycle Timer 110-5, which locations are manipulated in a manner to be further described. In addition, the completion of routine 109 activates the program routine 111 which indicates that a task has been placed within the cue stack 112. This causes line 111*a* to initiate the executive routine 117 explained as follows.

In the present example, as was noted previously, the first task to be performed is the dropping of the cup. The word representing this task had been previously loaded in the first location 112-2 in the cue stack 112. The cue stacker pointer 110*a* looks for task words stored in the stack and read out the first task word encountered in the cue stack, in this case, location 112-2, requesting a cup drop. This stored task causes the microprocessor 11 to control I/O expander 35 to energize the reed switch relay 36*c*-4 to cause its associated triac to energize the cup drop motor 70 during the next zero crossing of the power source signal as will be more fully described. Depending upon the particular selection made, and as previously noted, the times at which remaining operations are to begin have been stored within the cycle timerportion 110-5 of the timer stack 110. Such operations might include opening of the water valve; energization of those dispensing motors for dispensing each of the ingredients required to be dispensed for the selected drink; and so forth.

As part of the data collection portion of the cycle, decoders 32 and 33 are controlled by the microprocessor 11 to selectively scan those switches S-1 through S-13 whose settings are associated with the ingredients to be incorporated within the selected foodstuff. This data is stored in memory and is utilized to control the dispensing interval for each desired ingredient. Since all switches S1 through S13 are substantially identical to one another with regard to both design and basic function, only one switch will be described herein in detail.

Considering switch S1 which establishes the time interval during which water is dispensed, its switch arm S1*a* is movable to electrically engage any of the switch stationary contacts S1 b-1 through S1 b-11. The switch arm S1*a* in turn is coupled to output 32*d* of decoder 32. Each of the stationary output terminals S1 b-1 through S1 b-11 is connected to an associated output line. These lines couple stationary contacts S1 b-1 through S1 b-8 to the data input terminals DB1-DB7, respectively, of processor 11, while lines S1 b-9 through S1 b-11 are connected to the input lines 11*u*, 11*v*, and 11*w* of the microprocessor 11.

The interval of time, I, during which the water is dispensed is given by the equation I = minimum value + (scale factor × SS); wherein the minimum value is the smallest interval during which the water is to be dispensed; the scale factor is determined by the base timing value for each ingredient, and SS is the switch setting.

As shown in FIG. 1, capacitors C5 and C6 and crystal X1 form a clock which provides a frequency of the order of 5.7 MHz. This frequency is divided by an internal clock provided in microprocessor 11 to generate pulses at a repetition rate of 10 milliseconds. For example, the internal clock may comprise a 16 bit counter to divide the clock output in order to generate pulses occurring at 10 millisecond intervals.

Typically, the minimum value may be stored in memory (ROM) in the form of a multi-bit digital word representing the 2.55 second interval. The scale factor (1 second) is stored in ROM in a similar fashion. Presuming the first switch position to be chosen, i.e., presuming switch arm S1*a* to be engaged with stationary contact S1B-1, this represents a switch setting of zero, causing the interval during which hot water is dispensed to be equal to the minimum value, i.e., I=minimum value+(scale factor×SS) or I=2.55+(1.0×0)=2.55. The remaining switch positions represent integral multiples of unity, i.e., "1(1.0)", "2×(1.0)", "3×(1.0)", and so forth, so that the scale factor of 1 may be multiplied by a value in the range from zero through ten (10) to provide a time interval during which hot water (for example) is dispensed extending over the range of 2.55 seconds minimum up to a maximum of 12.55 seconds.

The water interval routine of the program cycle functions in the following manner:

When the water valve is opened in a manner to be more fully described, the above equation is solved simultaneously therewith. The base value and scale value factors are withdrawn from their memory locations within the read only memory (ROM). The data representing the switch position is then read in by the microprocessor and is converted into a binary code form suitable for manipulation by the microprocessor. The interval equation mentioned above is then solved using the base value, scale factor and switch setting values to determine the time interval over which the water is to be dispensed. This time interval is stored with a task word wherein the task word identifies the task to be performed at the end of the time interval, in this case, a deenergization of the water valve to terminate water flow. The time interval and its associated task work are stored in a predetermined group location 110-1 through 110-4 according to the ingredient.

Adjustment of the switches S1-S13 is quite simple and yet provides an accurate adjustment of the dispensing interval. For example, vending apparatus in one location may be designed to vend drinks in a six-ounce cup. The time interval required to dispense six ounces may, for example, be 5.5 seconds. Thus, switch arm S1a need only be set to engage stationary contact S1b-4 for a switch setting of 3, which when multiplied by the scale factor of 1 yields 3+2.55 or a total dispensing interval of 5.55 seconds. In the event that the same vending equipment is desired to dispense eight-ounce drinks, the settable switch S1 need only be adjusted to increase the dispensing interval by two seconds. The increment of each adjustment may be reduced by storing a smaller scale factor, if desired. For example, 0.8 seconds or 0.5 seconds, or even smaller values may be provided. The reduced range may be increased by adding more stationary contacts. The added switch positions may be stored as two data words.

The switches for the powdered ingredients function in much the same way as that described hereinabove for the hot water interval switch S1. Likewise, their accurate settings may be made in a simple and straightforward manner greatly simplifying field adjustments as compared with conventional cam switches.

The manner in which the interval during which each ingredient to be dispensed is controlled will now be described primarily in conjunction with FIGS. 1*a*, 1*b*, and 2:

The timer stack 110 is comprised of storage groups 110-0 through 110-4. Each group is capable of storing a time interval value and the task word associated therewith. For example, storage group 110-0 is utilized to store the interval during which water is to be dispensed; location 110-1 stores the interval during which the sugar is to be dispensed; location 110-2 stores the interval during which the powdered cream is to be dispensed; 110-3 stores the interval during which the powdered coffee is to be dispensed; and the cycle timer location 110-5 stores time values representing the instant at which the initiation of dispensing of each of the above ingredients is to occur after dropping of the cup.

The hardware timer 106 emits a timer interrupt signal every 10 milliseconds to trigger the real time service routine 112. As a result, timer stack pointer 110*a* is controlled to sequentially scan the group 110-0 through 110-5 and to extract the information stored therein. Due to the fact that processor calculations are performed at microsecond speeds, it is only upon the initiation of the dispensing of an ingredient that an interval computation is made for that ingredient and then placed in its appropriate group location 110-1 through 110-4 in the timer stack 110. Therefore, if, for example, the ingredient whose time interval is normally stored in group 110-1 has not yet been dispensed, the timer interval for which that ingredient yet to be dispensed will not have been calculated nor stored in group location 110-1. Therefore, the information extracted from each group must be tested (113 on FIG. 2) to determine if a time value has been stored therein. If the value tested is beyond a predetermined valid value, then the contents of the group being examined is designated as "inactive" (i.e., it contains no useful information). If "inactive", the timer stack pointer 110*a* is advanced to select the next group—see line 113*b* which activates routine 115. If the contents represents a value which is valid, the group contains "active" information and the time value stored therein is decremented by 1 count. See 113*a* (FIG. 2) which initiates the decrement routine 114.

For a time value which is active and has been decremented at 114, said value, after having been decremented by a count of 1, is tested to determine whether it has reduced to zero, i.e., to determine whether the counter has "rolled over", i.e., has been stepped to a zero count. In the event the test indicates that the count has not been reduced to a zero count, the remaining count is returned to its memory location, and the timer stack pointer 110*a* advances to the next group (see line 116*a* activating routine 115).

In the event that the value being examined at 116 has "rolled over" (i.e., stepped to zero), the "yes" condition 116*b* simultaneously triggers two operations, the first of which is that the task word associated with the value which has just stepped to zero is inserted into the cue stack 112 (see routine 111 which controls the cue stack pointer 112-1 to put the task applied thereto into the next available task storage location).

The other step simultaneously performed therewith is to disable the timer value at a "time-out" location by inserting a code in the first location of the timer value to prevent the value in that location from being counted any further during the present vend cycle. This is the "inactive" code referred to herein.

Each time a task is loaded into the cue stack, the program is caused to jump to the task execute routine (line 111*a*). The execute routine 117 looks to see if any tasks are stored in the cue stack. In the event that the cue stack 112 is empty, an inactive condition determined at 118 causes the watchdog timer (which may be a dedicated memory location or a register in processor 11) to be incremented by one count and the program jumps back to the scan keyboard routine to look for the presence of any "extra ingredient" requests. In the event that a task is stored in the cue stack (indicated as active at 118*b*), the watchdog timer is reset to a zero count (119) and, based upon the particular task, the microprocessor examines the zero crossing condition appearing at the interrupt input 11 of the microprocessor. In the event that a zero crossing is not present, operation of the device called for by the task word is delayed and the examination is repeated. The test is continuously repeated in this manner until a zero crossing condition occurs as indicated at 120*b*, at which time the task called for at 121 is performed. For example, assuming the task to be performed is the first task, namely, the dispensing of a cup, upon the occurrence of a zero crossing for the a.c. signal, the signal is developed through the I/O expander 35 to energize the relay of switch 36*c*-4 to energize the cup drop motor 70. Further tasks stored in the cue stack will be sequentially performed (only at a zero crossing) until all tasks stored in the stack 112 have been completed. When the last task has been performed, this condition appearing at 122*b* terminates the cycle and initializes the system. This may be accomplished by advancing the program counter to a value exceeding the capacity of internal memory (ROM) to develop the signal PSEN at output 116 of the microprocessor 11 to cause the program to be reset in readiness for the next vending cycle.

The watchdog timer is reset every time a task occurs and is incremented when no task occurs during the executive loop. The watchdog timer (a multibit counter) times out after a predetermined interval during which no task has been performed since performance of the last completed task, indicating a system malfunction. During the executive loop routine, the inactive condition (107*b*) triggers routine 118 to examine the watchdog timer. 105*b* returns to the keyboard routine and reenters into the executive loop which again triggers a search for tasks in the cue stack. This time, the watchdog timer is incremented and the key scan routine is again reentered. However, any task discovered in cue stack 112 resets the watchdog timer to zero. Since a full vend cycle should be completed within a maximum of 12–13 seconds, and, more frequently, in 10–12 seconds, and since a number of tasks (at least five) occur during each vend cycle, by setting the watchdog timer to restart the machine operation if some outside time limit is reached, the system is provided with a backup capability in the remote event that all other safety checks fail to terminate system operation.

The initiation of each dispensing operation can be seen to be preset in accordance with the cycle timer 110-5, while the termination of each dispensing interval is controlled by the length of the time interval associated with each of the turn-off tasks established by their associated switches S1-S13. It should be noted that all tasks, whether they be turn-on or turn-off of a dispensing device, are transferred to the cue stack and performed in the order in which they are loaded onto the cue stack. For example, the first task performed is that of dropping a cup into the cup well. The next task to be performed is the initiation of water flow, i.e., the energization of the hot water valve 73, 74 or 75 to enable the flow of water to the appropriate mixing bowl. The next task to be performed is the dispensing of sugar (motor 78) and then creamer (77) and then coffee powder (66) to the mixing bowl. All of these tasks constitute turn-on or energization of their associated motors or solenoids to initiate dispensing of a particular ingredient. These tasks all occur at predetermined time intervals measured from the cup drop task and established by the values stored in the cycle timer 110-5.

The times in which each of these dispensing intervals are terminated are established by the values stored in groups 110-0 through 110-4 which are decremented by a count of 1 at ten millisecond intervals until they "roll over", at which time the task associated with the counter which has just rolled over is entered into the cue stack.

The tasks are taken in the order in which they are stored in the cue stack 112 and, depending upon their identity, are caused to deenergize a valve or solenoid identified by the task word to cause termination of that particular ingredient.

The program has been designed to require a number of program steps which is preferably no greater than the internal storage capacity of processor 11. If the preset number of valid program steps is exceeded (indicating a malfunction), based upon the count of the program counter, output line 11*b* goes high, causing inverter 17 to apply a low level to the inverting input of operational amplifier 16. This level is compared against the reference level established at the noninverting input of operational amplifier 16 causing the operational amplifier output to apply a reset signal at 11*a* which serves to reset or initialize the processor. More specifically, the program counter of the microprocessor 11 is incremented after completion of each program step. In the present system, the internal memory addresses are sufficient to store the number of program steps required for the vend cycle, including all drink selections. As soon as the program counter calls for an address in memory of 1024 (in decimal) or greater, the program store enable signal (PSEN) is generated at output 116, typically employed to enable an external memory device. In the present system, the signal PSEN is coupled to the input 16*b* of operational amplifier 16 through inverter 17 to cause a signal to be applied to reset input 11*a* by the output of operational amplifier 16.

It should be understood that while this invention has been described with respect to a particular embodiment thereof, numerous others will become obvious to those of ordinary skill in the art in light thereof. For example, the time values may be incremented, and time-out may occur when the stored count reaches full capacity. Also, the time value may be stored and the contents of an associated register is first cleared and thereafter incremented at 10 millisecond intervals, and then compared against the stored value after it is incremented. When the stored count and the register count compare, the task is performed. Obviously, other alternatives may be employed.

What is claimed is:

1. Means for dispensing a predetermined quantity of material comprising:

a source of said material;

normally disabled dispensing means for dispensing a measured amount of said material from said source when enabled;

means responsive to a dispensing request signal for enabling said dispensing means;

timing means responsive to the enabling of said dispensing means for disabling said dispensing means a selectable time interval after enablement, said timing means including switch means comprising an input, a plurality of outputs and a settable switch arm for selectively coupling said input to one of said outputs in accordance with the selected time interval, counter means and transfer means responsive to the setting of the switch means for setting a count in the counter means representing the length of time said dispensing means is enabled, and means for altering the count in said counter means.

2. The apparatus of claim 1, further comprising means for applying a scan signal to said switch means input; said transfer means including count value development means responsive to the output line carrying said scan signal for developing a count value associated with the switch means output carrying the scan signal, each of said outputs being adapted to cause said count value developing means to develop a different count value for each switch output in accordance with the position of said settable switch arm.

3. The apparatus of claim 1, wherein said altering means comprises a timing pulse generator; means responsive to enablement of said dispensing means for altering the count in said counter means upon the occurrence of each timing pulse.

4. The apparatus of claim 3, further comprising means responsive to a second count in said counter means different from the count initially set therein for disabling said dispensing means.

5. The apparatus of claim 1, wherein said counter means comprises a binary counter, said transfer means comprising means for converting the output states at the outputs of said switch means into a multi-bit binary word and loading said binary word into said binary counter.

6. The apparatus of claim 5, further comprising means for generating a dispensing disabling signal when the count in the binary counter is reduced to zero.

7. Apparatus for dispensing predetermined quantities of each of a plurality of different materials comprising:

a source of each material:

normally disabled dispensing means for each source for dispensing the material from its associated source when enabled;

timing means for each dispensing means responsive to the enabling of its associated dispensing means for disabling its associated dispensing means a selectable time interval after enablement;

each of said timing means including switch means comprising an input, a plurality of outputs, and a settable switch arm for selectively coupling said input to one of said outputs in accordance with the selected time interval, counter means and transfer means responsive to the setting of the switch means for setting a count in the counter means representing the length of time said dispensing means is enabled and altering means for altering the count in said counter means.

8. The apparatus of claim 7, wherein said counter means comprises a binary counter, said transfer means comprising means for converting the output states at the outputs of said switch means into a multi-bit binary word and loading said binary word into said counter means.

9. The apparatus of claim 7, wherein said altering means comprises a timing pulse generator; means responsive to enablement of said dispensing means for altering the count in said counter means upon the occurrence of each timing pulse.

10. The apparatus of claim 9, further comprising means responsive to a second count in said counter means different from the count initially set therein for disabling said dispensing means.

11. Means for dispensing predetermined quantities of each of a plurality of different materials in a predetermined sequence, comprising:

a source for each material;

normally disabled dispensing means for each source for dispensing material from its associated source when enabled;

sequencing means responsive to a dispensing request signal for enabling said dispensing means in a predetermined sequence and at spaced intervals of time;

timing means associated with each dispensing means responsive to enablement of its associated dispensing means for disabling its associated dispensing means at a selected time after its enablement, said timing means each including settable switch means having a plurality of discrete switch positions for adjusting the length of said selected time, each switch means being comprised of an input and a plurality of outputs, and a switch arm settable to couple said input to any one of said outputs in accordance with the desired time interval.

12. The apparatus of claim 11, wherein said timer means each comprise counter means and pulse means for decrementing all of said counter means at a predetermined pulse rate;

means responsive to the reduction of the count in each counter means to zero for disabling the dispensing means associated therewith.

13. The apparatus of claim 11, wherein each of said timing means comprises a counter; means responsive to the setting of the switch means associated with said counter for setting a count into its associated counter; pulse means for reducing the counts in all of the counters at regular timing intervals; and means responsive to a zero count in each counter for disabling the dispensing means associated with the counter whose count has been reduced to zero count.

14. Means for dispensing a predetermined quantity of material into a receptacle, comprising:

a source of said material;

normally disabled dispensing means for dispensing a measured amount of said material from said source into said receptacle when enabled;

means responsive to a dispensing request signal for generating a dispensing enabling signal and a scan signal;

switch means comprising an input for receiving said scan signal, a plurality of outputs and a manually settable switch arm for selectively coupling said input to one of said outputs in accordance with the desired quantity of said material to be dispensed;

timer means;

means coupled to said switch means outputs and responsive to said scan signal applied to the input of the switch means for setting a time value in said timer means in accordance with the setting of said switch arm;

means for operating said timer means responsive to the enabling of said dispensing means;

means responsive to time-out of the timer means in accordance with the time value setting for disabling said dispensing means.

15. The dispensing means of claim 14, wherein said timer means comprises a counter; and said timer operating means comprises timing pulse generating means for altering the count in said counter.

16. A method for controlling vending apparatus having a plurality of dispensing means, each adapted to dispense a different ingredient, and settable switch means, each associated with a dispensing means and being settable in accordance with the desired quantity of the associated ingredient to be dispensed, wherein the method is comprised of the steps of:

examining the drink selection push buttons manipulated by the operator to establish which ingredients are to be dispensed;

enabling those dispensing means associated with the ingredients to be dispensed in a predetermined sequence;

scanning those settable switches associated with the ingredients to be dispensed and converting the examined switch settings into values representative of the quantity of the associated ingredients;

storing each of said values;

generating timing pulses;

altering the counts of each of the aforesaid stored values upon the occurrence of each timing pulse;

disabling the associated dispensing means when the predetermined count associated therewith reaches a second value.

17. The method of claim 16, further comprising the steps of:

providing a.c. power for powering said dispensing means;

examining the a.c. power signal to ascertain the occurrence of zero crossings;

delaying the enablement and disablement of each of said dispensing means until the occurrence of the next zero crossing of the power source signal.

18. The method of claim 16, wherein one of the dispensing means includes means for dispensing a liquid ingredient and further comprising the steps of:

continuously monitoring the flow of liquid; and promptly halting the dispensing operation in the event of the absence of liquid flow during the time that the dispensing means for dispensing the liquid is enabled.

19. The method of claim 16, further comprising the steps of counting the number of program steps in the program which operates the processor for controlling the vending operation;

immediately terminating the vending operation when the count exceeds a predetermined count to establish that the program counter has advanced to a count requesting an invalid program step.

20. The method of claim 16, wherein the processor is powered by a conventional a.c. power source and further comprising the steps of monitoring the output of the power source and immediately terminating the vending operation when the output of the power source falls below a predetermined level.

21. The method of claim 20, wherein the step of detecting the level of the power source further comprises the steps of:

rectifying and filtering the a.c. signal to establish a d.c. level; and deriving a reference level from said d.c. level; comparing said d.c. level with said reference level; and terminating the vending operation when the d.c. level falls below said reference level.

22. Vending apparatus including a processor powered by a low power d.c. source;

a plurality of dispensing devices each adapted to dispense a separate ingredient and being powered by an a.c. source;

said processor including coupling means for selectively coupling said a.c. source to said dispensing means in accordance with a predetermined sequence;

said coupling means further including means having a plurality of outputs, each associated with one of said dispenser means for generating a signal of a first level when it is desired to energize its associated dispensing means and a second level when it is desired to terminate energization of its associated dispensing means;

low power d.c. operated control means having input means coupled to each of said outputs and being enabled when the associated output of said coupling means is at said first level;

said control means having output means electrically isolated from its associated input means and being activated when its associated input means is activated;

triac means having first and second electrodes coupled between said dispensing means and said a.c. power source;

each of said triac means further comprising a control electrode coupled to an associated one of said output means for rendering the triac conductive when its associated output means is activated, whereby the processor controls coupling of the dispensing means to said a.c. source while completely isolating said d.c. source from said a.c. source; and means for monitoring the a.c. power level for delaying switching of any of said dispensing means except during a substantially zero crossing condition of the signal emitted by the a.c. source.

23. The vending apparatus of claim 22, wherein each control means comprises a reed switch assembly, said input means comprising a winding, and said output comprising a reed switch operated by said winding.

24. A method for controlling vending apparatus having a plurality of dispensing means, each energizable by an a.c. signal, each adapted to dispense a different ingredient, and having a group of manually operable selection buttons, wherein the method is comprised of the steps of:

(a) examining the selection buttons manipulated by the operator to establish which ingredients are to be dispensed;

(b) enabling those dispensing means associated with the ingredients to be dispensed in a predetermined sequence;

(c) disabling each dispensing means when the desired amount of ingredient has been dispensed;

(d) examining the a.c. signal to ascertain the occurrence of zero crossings;

(e) delaying the enablement and disablement of each of said dispensing means until the occurrence of the next zero crossing of the a.c. signal coincides with the enabling operation and with the disabling control condition.

25. The method of claim 24, wherein one of the dispensing means includes means for dispensing a liquid ingredient and further comprising the steps of continuously monitoring the flow of liquid and promptly halting the dispensing operation in the event of the absence of liquid flow during the time that the dispensing means for dispensing the liquid is enabled.

26. The method of claim 24, further comprising the steps of counting the number of program steps in the program which operates the processor for controlling the vending operation;

immediately terminating the vending operation when the count exceeds a predetermined count to establish that the program step count has advanced to a value requesting an invalid program step.

27. The method of claim 24, wherein the power for operating the processor is derived from a conventional a.c. power source and further comprising the steps of:

converting the a.c. signal from the a.c. power source to a d.c. signal;

monitoring the d.c. signal and immediately terminating the vending operation when the d.c. signal falls below a predetermined value.

28. The method of claim 27, further comprising the steps of:

deriving a reference level from said d.c. level; and comparing said d.c. level on said reference level to terminate the vending operation when the d.c. level falls below said reference level.

29. Means for sequentially dispensing predetermined amounts of disparate materials, comprising:

a plurality of sources of said materials, each of said plurality of sources being associated with one of said disparate materials;

a plurality of normally disabled means, each being adapted for dispensing a measured amount of material from its associated source when enabled;

means responsive to a dispensing request signal for generating a dispensing enabling signal and a scan signal;

a plurality of switch means, each comprising an input for receiving a scan signal, a plurality of outputs and a manually settable switch arm for selectively coupling said input to one of said outputs in accordance with the desired quantity of material to be dispensed from its associated source;

timer means associated with each of said switch means;

means for coupling said dispensing enabling signal to a first one of said dispensing means and for coupling said scan signal to the input of that switch means associated with said first one of said dispensing means;

means responsive to the output of said last mentioned switch means carrying the scan signal for setting a time value in the associated timer means representative of the setting of the switch arm of said last mentiond switch means;

means responsive to the enabling of said dispenser means for starting its associated timer means;

means responsive to time out of each timer means for disabling the dispensing means associated with the timer means which has just timed out;

said coupling means comprising sequencing means coupling said dispensing enabling signal to said dispensing means and said scan signal to said switch means in a predetermined sequence, whereby said dispensing means are enabled in a predetermined sequence, while each timer means controls the disabling of its associated dispensing means to dispense the desired amount of each material.

30. A method employing settable switch means for operating a normally disabled dispensing means to dispense a measured amount of material derived from a source of said material into a receptable when enabled, said method comprising the steps of:

generating timing signals at a predetermined uniform rate;

enabling said dispensing means upon the occurrence of a dispensing request;

scanning the switch means to determine a value in accordance with the setting of the settable switch means, which value represents a predetermined time period;

counting said time signals;

disabling the dispensing means when the number of timing signals counted compares with said value, whereby the desired amount of said material is dispensed into the said receptacle.

31. A method employing settable switch means having an input and a plurality of outputs for operating a normally disabled dispensing means to dispense a measured amount of material derived from a source and said material into a receptacle when enabled, said method comprising the steps of:

generating timing signals at a predetermined uniform rate;

enabling said dispensing means upon the occurrence of a dispensing request;

applying a scan signal to the input of the switch means and setting a count into a counter representative of the output of the switch means carrying the scan signal in accordance with the setting of the settable switch means;

reducing the count in the counter by one upon the occurrence of each timing signal generated after the setting of said count;

disabling the dispensing means when the count in the counter equals a second predetermined count less than said set count, whereby the desired amount of said material is dispensed into the said receptacle.

32. A method for sequentially dispensing predetermined measured amounts of a group of disparate materials wherein each material is derived from a source, and each source includes a normally disabled dispensing means for dispensing its associated material when enabled, and whereby each quantity dispensed is accurately determined by plural settable switch means, each having an input and a plurality of outputs, each switch means being associated with one of said dispensing means, said method comprising the steps of:

enabling selective ones of said dispensing means upon the occurrence of a dispensing request and counting the timing signals starting with said next occurring timing signal for each dispensing means which is enabled;

applying a scan signal to each switch means in sequential fashion and establishing a time value representative of that output of the switch means carrying the scan signal in accordance with the setting of a settable switch arm of the switch means being scanned;

measuring elapsed time for each dispensing means as the dispensing means is enabled;

disabling each enabled dispensing means when the elapsed time measured compared with its associated time value.

33. A method for sequentially dispensing predetermined measured amounts of a group of disparate materials wherein each material is derived from a source, and each source includes a normally disabled dispensing means for dispensing its associated material when enabled, and whereby each quantity dispensed is accurately determined by plural settable switch means, each having an input and a plurality of outputs, each switch means being associated with one of said dispensing means, said method comprising the steps of:

enabling each of said dispensing means in accordance with a predetermined sequence;

scanning the inputs with a scan signal to establish a time value representative of that output of each switch means carrying the scan signal in accordance with the setting of a settable switch arm of each switch means;

for each dispensing means, measuring the elapsed time since enablement of each dispensing means;

disabling each enabled dispensing means when the elapsed time measured compares with the time value established by the switch means associated with that dispensing means.

34. Means for preparing a liquid based foodstuff in a receptacle, said liquid-based ingredient being comprised of a liquid admixed with at least one non-liquid ingredient, preferably in powdered form, comprising:

a source of said liquid-based ingredient;

at least one source of a powdered ingredient;

a plurality of normally disabled dispensing means, each associated with one of said sources for dispensing a measured amount of the ingredient associated therewith into said common receptacle when enabled;

timing means for generating regularly spaced timing pulses;

means responsive to a dispensing request signal for generating a dispensing enabling signal and a scan signal;

plural switch means, each being associated with one of said dispensing means and each being comprised of an input for receiving said scan signal, a plurality of outputs and a manually settable switch member for selectively coupling said input to one of said outputs in accordance with the desired quantity of the associated ingredient to be dispensed;

plural counter means each associated with one of said switch means;

sequencing means for sequentially coupling the dispensing enabling signal to each of said dispensing means and for coupling the scan signal to the inputs of the switch means in accordance with the said sequence employed for enabling said dispensing means;

means responsive to state of the outputs of each switch means for setting a count in its associated counter means in accordance with the setting of the switch arm of its associated switch means;

means for decrementing the count in each counter means by one count upon the occurrence of each timing pulse;

means responsive to a second predetermined count in each of said counter means different from the count set therein for disabling the dispensing means whose associated counter means has reached said second count.

35. A method which employs settable switches for preparing a liquid based foodstuff in a receptacle by operating plural normally disabled dispensing means adapted to dispense measured amounts of ingredients derived from sources of said ingredients, said ingredients being dispensed into said common receptacle, wherein the method comprises the steps of:

generating timing signals at a predetermined uniform rate;

enabling a first one of said dispensing means upon the occurrence of a dispensing request;

applying a scan signal to the input of the switching means associated with the enabled dispensing means and setting a count in a register associated with each switching means dependent upon the output of the switching means which carries said scan signal in accordance with the setting of the settable switch means associated with the ingredient being dispensed;

counting the number of timing signals generated after the setting of said count;

disabling said first one of said dispensing means dispensing the first mentioned ingredient into said common receptacle when the number of timing signals counted compares with the aforementioned set count so that the desired amount of the first dispensed ingredient is now contained in the common receptacle;

enabling the dispensing means of another one of said ingredients;

applying a scan signal to the input of the switching means associated with the next ingredient to be dispensed to set a count in a register associated with the last mentioned switching means dependent upon the output of the last mentioned switching means which carries said scan signal in accordance with the setting of the last mentioned switching means;

counting the number of timing signals generated after the setting of the last mentioned count;

disabling the last mentioned dispensing means when the number of timing signals counted equals the last mentioned count, whereby the last selected ingredient is dispensed into said receptacle.

36. A method for sequentially dispensing predetermined measured amounts of a group of disparate materials into a common receptacle wherein each material is derived from a source, and each source includes a normally disabled dispensing means for dispensing its associated material when enabled, and whereby each quantity dispensed is accurately determined by plural settable switch means, each being associated with one of said dispensing means, said method comprising the steps of:

generating timing signals at uniformly spaced intervals;

enabling selected ones of said dispensing means upon the occurrence of a dispensing request and counting the timing signals starting with said next occurring timing signal;

sequentially applying a scan signal to each of the switching means associated with the material being dispensed upon the enablement of the selected dispensing means, and storing a value representative of the output state of the last mentioned switch means in accordance with the setting of a settable switch arm of the switch means;

sequentially comparing the count of timing signals with each stored value each time the count is incremented;

disabling the enabled dispensing means when the count of timing signals compares with the stored count associated with the dispensing means, whereby the dispensing cycle is completed when the last enabled dispensing means is disabled.

37. A method which employs settable switches for preparing a liquid based foodstuff in a receptacle by operating plural normally disabled dispensing means adapted to dispense measured amounts of ingredients derived from sources of said ingredients, said ingredients being dispensed into said common receptacle, wherein the method comprises the steps of:

generating timing signals at a predetermined uniform rate;

enabling a group of said dispensing means in a predetermined sequence upon the occurrence of a dispensing request;

sequentially scanning those switches associated with the enabled dispensing means by applying a scan signal to the input of each of the last mentioned group of switching means and setting a value into a memory device, which value represents the output of the switching means which carries the scan signal in accordance with the setting of the settable switch means associated with the ingredient being dispensed;

counting the number of timing signals generated after the storing of each of said values;

comparing the count of timing signals with each stored value each time the count is incremented;

disabling each dispensing means when the number of timing signals counted compares with the aforementioned set count associated with said dispensing means so that the desired amount of the first dispensed ingredient is now contained in the common receptacle, whereby the dispensing operation is completed when all of the dispensing means are disabled.

38. A vending apparatus comprising:

plural vending means;

a processor having program means for operating the processor in a predetermined sequence and memory means for storing signals;

a plurality of manually operable control means for selecting the item to be vended;

a plurality of response means for detecting the states of the control means, each of said plurality of response means being operatively connected to the processor for signaling the processor that respective ones of said plurality of response means have detected the state of selected ones of said plurality of control means;

a plurality of display means for presenting information based upon a detecting of selected ones of said plurality of control means by respective ones of said plurality of response means, each display means having a display activation means associated therewith and operatively connected to the processor for activating the display means in response to signals from the processor;

said processor including multiplexing means for cyclicly and sequentially enabling each of said plurality of control means to enable connected ones of said plurality of said response means to signal the processor that said connected ones of said plurality of response means have detected the conditions of enabled, associated ones of said plurality of control means, and enabling each of the display activation means to activate its associated display means in accordance with the conditions of said enabled ones of said plurality of control means;

said processor having means for storing the condition of enabled ones of said plurality of control means in said memory means, for addressing the programming means and the memory means, and for selectively operating the vending means, in response to the program means, the memory means and said condition of said control means.

39. A method for operating a vending apparatus to dispense predetermined quantities of disparate ingredients through the control of associated normally disabled dispensing means and including a control panel having push buttons for selecting the desired foodstuff to be dispensed, the method being comprised of the steps of:

enabling a first group of said push buttons when a coin is deposited in the vending machine;

storing the state of the first group of push buttons in a first memory location;

enabling a second group of push buttons and storing the state of said second group of push buttons in a second memory location;

scanning selected ones of a plurality of switch means associated with each ingredient to be dispensed in accordance with the data stored in the aforesaid memory locations representative of the foodstuff selected by the operator;

storing the state of each of the scanned switch means in separate memory locations wherein the state of each scanned switch is determined by the setting of its adjustable switch arm;

determining the quantity of ingredient to be dispensed in accordance with the switch arm position of the associated switch means which has been stored in an associated memory location;

activating those dispensing means associated with the ingredients to be dispensed in a predetermined sequence;

applying the value representative of the amount of ingredient to be dispensed into an associated counter means when the dispensing means for that ingredient is enabled;

generating timing pulses;

decrementing each of said counts upon the occurrence of each timing pulse;

disabling the dispensing means associated with each counting means when the count in its associated counting means rolls over.

40. A method employing a computer including a memory for controlling the order of initiation of a plurality of operations performed by a plurality of devices and for controlling the interval during which each of said devices is energized to cause said operations to be performed, comprising the steps of:

(a) allocating a first group of locations in said memory for storing a task word and a time value word in each location wherein a task word identifies the task to be performed and the time value word identifies the time at which the task is to be performed;

(b) allocating a second group of memory locations wherein each location is capable of storing a task word;

(c) generating time pulses and sequentially extracting each time value word from said memory responsive to a start request and the next timing pulse;

(d) decrementing the extracted time value by one count;

(e) returning the decremented value to its memory location in said first group if the count is greater than zero;

(f) transferring the task word from its memory location in said first group to the first available memory location in said second group if its time value has been reduced to zero;

(g) repeating steps (c) through (f) upon the occurrence of each succeeding timing pulse;

(h) sequentially scanning each memory location in said second group;

(i) energizing the device identified by the task word which calls for energization; and (j) de-energizing the device identified by the task word which calls for de-energization of the device.

41. A method for controlling the sequence of performance of a plurality of operations to be performed by devices, said method utilizing a computer having a memory, said method comprising the steps of:

(a) storing each task to be performed in the form of a word in a first group predetermined location in said memory responsive to a requested operation;

(b) providing a plurality of settable switches, each allocated to one of said tasks, each being set to a position representative of the time interval during which the task associated therewith is to be performed;

(c) sequentially scanning those switches whose tasks have previously been stored to store a word presenting time values in said first group of locations in memory together with its associated task word;

(d) allocating a second group of memory locations, wherein each location is capable of storing a task word;

(e) generating time pulses and sequentially extracting each time value word from memory responsive to the next timing pulse;

(f) decrementing the extracted time value by one count;

(g) returning the decremented value to its memory location in said first group if the count is greater than zero;

(h) transferring the task word from its memory location in said first group to the first available memory location in said second group if its time value has been reduced to zero;

(i) repeating steps (e) through (h) upon the occurrence of each succeeding timing pulse;

(j) sequentially scanning each memory location in said second group;

(k) energizing the device identified by the task word which calls for energization of such device; and (l) de-energizing the device identified by the task word which calls for de-energization of such device.

42. Means for dispensing predetermined quantities of each of a plurality of different materials in a predetermined sequence, comprising:

a source of material;

normally disabled dispensing means for each source for dispensing material from its associated source when enabled;

sequencing means responsive to a dispensing request signal for enabling said dispensing means in a predetermined sequence and at spaced intervals of time, said sequencing means including a plurality of timer means, each adapted to time out a predetermined time after said dispensing request signal; and timing means associated with each dispensing means responsive to enablement of its associated dispensing means at a selected time after its enablement, said timing means each including settable switch means having a plurality of discrete switch positions for adjusting the length of said selected time.

* * * * *